US009850083B2

(12) United States Patent
Nishiyama

(10) Patent No.: US 9,850,083 B2
(45) Date of Patent: Dec. 26, 2017

(54) SHEET CONVEYING APPARATUS AND IMAGE FORMING APPARATUS

(71) Applicant: CANON KABUSHIKI KAISHA, Tokyo (JP)

(72) Inventor: Tatsuo Nishiyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/019,065

(22) Filed: Feb. 9, 2016

(65) Prior Publication Data

US 2016/0257508 A1 Sep. 8, 2016

(30) Foreign Application Priority Data

Mar. 5, 2015 (JP) ..... 2015-043473

(51) Int. Cl.
*B65H 3/06* (2006.01)
*B65H 5/06* (2006.01)
(Continued)

(52) U.S. Cl.
CPC ..... *B65H 3/0684* (2013.01); *B65H 1/266* (2013.01); *B65H 3/0669* (2013.01); *B65H 5/062* (2013.01); *B65H 5/36* (2013.01); *B65H 5/38* (2013.01); *B65H 2403/513* (2013.01); *B65H 2403/5331* (2013.01); *B65H 2403/541* (2013.01); *B65H 2404/1521* (2013.01); *B65H 2404/50* (2013.01); *B65H 2404/6111* (2013.01); *B65H 2405/114* (2013.01); *B65H 2405/32* (2013.01)

(58) Field of Classification Search
CPC .... B65H 1/266; B65H 3/0607; B65H 3/0661; B65H 3/0684; B65H 2404/152; B65H 2404/1521; B65H 2405/32
USPC ..... 271/117, 118
See application file for complete search history.

(56) References Cited

U.S. PATENT DOCUMENTS 6,217,018 B1 * 4/2001 Tay ..... B65H 1/266 271/145
7,472,904 B2 * 1/2009 Park ..... B65H 3/0684 271/117
(Continued)

FOREIGN PATENT DOCUMENTS

JP 2009-107823 A 5/2009
JP 2012-001316 A 1/2012
(Continued)

*Primary Examiner* — Ernesto A Suarez
(74) *Attorney, Agent, or Firm* — Fitzpatrick, Cella, Harper & Scinto

(57) ABSTRACT

A sheet conveying apparatus includes a stacking unit, a feeding member, a conveyance guide, and a movement unit. The stacking unit is drawably mounted on an apparatus body and includes a stacking member on which a sheet is stacked. The feeding member feeds the sheet stacked on the stacking member. The conveyance guide is provided with an opening and disposed above the stacking unit. The conveyance guide configures a conveyance path through which the sheet is conveyed. The movement unit moves the feeding member between a first position on which the feeding member comes into contact with the sheet stacked on the stacking member and a second position disposed above the first position. The movement unit includes an entry portion configured to be located within the opening in a state where the feeding member is positioned at the second position.

17 Claims, 10 Drawing Sheets

(51) Int. Cl.

| | |
|---|---|
| ***B65H 5/36*** | (2006.01) |
| ***B65H 1/26*** | (2006.01) |
| ***B65H 5/38*** | (2006.01) |

(56) References Cited

U.S. PATENT DOCUMENTS

| | | | | |
|---|---|---|---|---|
| 7,918,445 | B2 * | 4/2011 | Okamoto | B65H 3/0669 271/117 |
| 8,186,671 | B2 | 5/2012 | Nishiyama | |
| 8,768,235 | B2 * | 7/2014 | Asada | B41J 3/60 271/10.09 |
| 9,242,488 | B2 | 1/2016 | Samoto et al. | |

FOREIGN PATENT DOCUMENTS

| | | | |
|---|---|---|---|
| JP | 2013-116799 | A | 6/2013 |
| JP | 2014-088227 | A | 5/2014 |

* cited by examiner

SHEET CONVEYING APPARATUS AND IMAGE FORMING APPARATUS

BACKGROUND OF THE INVENTION

Field of the Invention

The present invention relates to a sheet conveying apparatus conveying a sheet and an image forming apparatus including the same.

Description of the Related Art

Conventionally, an image forming apparatus, in which a sheet tray is detachably mounted on an apparatus body and a sheet that is stacked in the sheet tray is fed by a pickup roller, is disclosed in JP-A-2014-88227. A sheet tray and a sheet-feeding mechanism including the same configuration as the above-described image forming apparatus are illustrated in FIG. 10.

A sheet-feeding mechanism 332 includes a separating roller 316, a pickup roller 308, and an abutting portion 350. The pickup roller 308 is swingably supported by a holder 347 about a roller shaft 343 of the separating roller 316. The abutting portion 350 is configured to interlock with the pickup roller 308 via a link 310.

A sheet tray 324 includes cams 324*a*, 324*b*, 324*c*, and 324*d* in a left end portion thereof. When the sheet tray 324 is mounted on an apparatus body, the abutting portion 350 engages with the cam 324*d* and the pickup roller 308 is positioned at a first position in which the pickup roller 308 abuts against a sheet that is stacked in the sheet tray 324. When the sheet tray 324 is removed from the apparatus body, the abutting portion 350 moves away from the cam 324*a* and the pickup roller 308 is positioned at a second position in which the pickup roller 308 moves upward away from the sheet that is stacked in the sheet tray 324 by an urging force of a spring 333.

By the way, in recent years, demand for a compact printer and a copier in the office or at home has been increasing. Thus it is desirable to downsize a sheet conveying apparatus, which is provided in the printer and the copier, in the height direction.

However, upon downsizing a product with that sheet-feeding mechanism 332, there is a concern that the holder 347 and the link 310 interfere with a conveyance guide provided above the pickup roller 308 in a case when the pickup roller 308 is moved from the first position to the second position. Thus, it has been difficult to achieve both downsizing of the product and ensuring a sufficient moving space for the pickup roller 308 to contact with and apart from the sheet.

SUMMARY OF THE INVENTION

According to one aspect of the invention, a sheet conveying apparatus includes a stacking unit, a feeding member, a conveyance guide, and a movement unit. The stacking unit is drawably mounted on an apparatus body and includes a stacking member on which a sheet is stacked. The feeding member feeds the sheet stacked on the stacking member. The conveyance guide is provided with an opening and disposed above the stacking unit. The conveyance guide configures a conveyance path through which the sheet is conveyed. The movement unit moves the feeding member between a first position on which the feeding member comes into contact with the sheet stacked on the stacking member and a second position disposed above the first position. The movement unit includes an entry portion configured to be located within the opening in a state where the feeding member is positioned at the second position.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
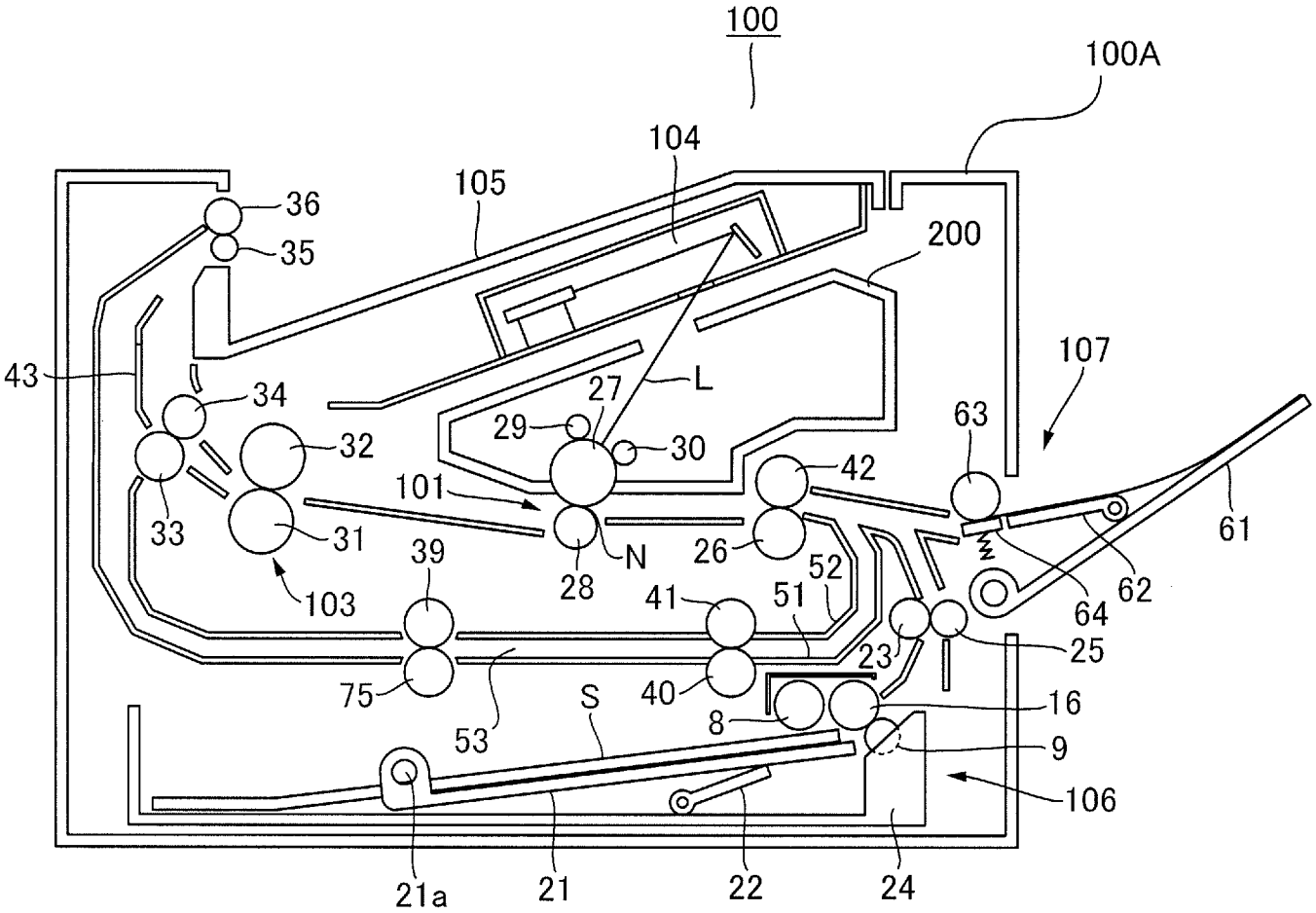
FIG. 1 is a schematic diagram illustrating a printer according to the first embodiment.

A first embodiment of this disclosure will be described. A printer 1, i.e., an image forming apparatus according to the first embodiment, is an electrophotographic laser beam printer. As illustrated in FIG. 1, the printer 1 includes a sheet conveying apparatus 106 configured to convey the sheet, a multi-feeding portion 107, an image forming portion 101, and a fixing portion 103.

The image forming portion 101 includes a cartridge 200 that is detachable with respect to an apparatus body 100A, a transfer roller 28, and a laser scanner unit 104. The cartridge 200 includes a photosensitive drum 27, a charger 29, and a developer 30. When an image formation command is output to the printer 1, an image forming process is started by the image forming portion 101 based on image information input from an external device such as a computer connected to the printer 1. The laser scanner unit 104 applies laser light L to the photosensitive drum 27 based on the input image information. Then an electrostatic latent image is formed by the applied laser light L on the photosensitive drum. 27, which has been charged in advance by the charger 29. Thereafter, the electrostatic latent image is developed by the developer 30 and a toner image is formed on the photosensitive drum 27.

A sheet S stacked in an intermediate plate 21 of the sheet conveying apparatus 106 is fed by a pickup roller 8, i.e., a feeding member, in parallel to the image forming operation described above. The sheets S are separated one by one by a feed roller 16 and a separating roller 9, and are conveyed to registration roller pair 26 and 42 by conveyance roller pair 23 and 25.

The registration roller pair 26 and 42 form a loop in the sheet S to correct skewing and conveys the sheet S to a transfer nip N formed between the photosensitive drum 27 and the transfer roller 28 at a predetermined conveying timing. A transfer bias is applied to the toner image on the photosensitive drum 27 from the transfer roller 28, and the toner image is transferred to the sheet S at the transfer nip N. The sheet S to which the toner image is transferred is conveyed to the fixing portion 103 and the toner image is fixed by a heating roller 32 and a pressing roller 31 of the fixing portion 103. Then, the sheet S is conveyed by conveyance roller pair 33 and 34, and discharging roller pair 35 and 36, and is discharged on a discharge tray 105.

Upon forming images on both sides of the sheet S, the discharging roller pair 35 and 36 are driven in a reverse rotation direction after the rear end of the sheet S with the image formed on its first surface (front surface) passes through a conveyance guide 43. Thus, the sheet S is guided to a duplex path 53 and is conveyed by first duplex conveyance roller pair 75 and 39. Furthermore, the sheet S is conveyed by second duplex conveyance roller pair 40 and 41, and is guided to the registration roller pair 26 and 42 by conveyance guides 51 and 52 configuring a part of the duplex path 53, i.e., a conveyance path. Similar to the first surface, another image is formed on the second surface of the sheet S at the transfer nip N, and the sheet then discharged on the discharge tray 105.

The multi-feeding portion 107 includes a multi-tray 61 that pivotably supports a multi-intermediate plate 62 on which the sheets are mounted, a multi-feeding roller 63, and a separating pad 64 disposed to face the multi-feeding roller 63. When a signal for feeding the sheet from the multi-feeding portion 107 is transmitted from a control unit 80 (see FIG. 4), the multi-feeding roller 63 rotates to feed the sheet mounted on the multi-intermediate plate 62 toward the registration roller pair 26 and 42. The multi-feeding portion 107 is capable of feeding a sheet that cannot be fed from the sheet conveying apparatus 106 such as an A3-size sheet and a postcard-size sheet.

Figure 2:
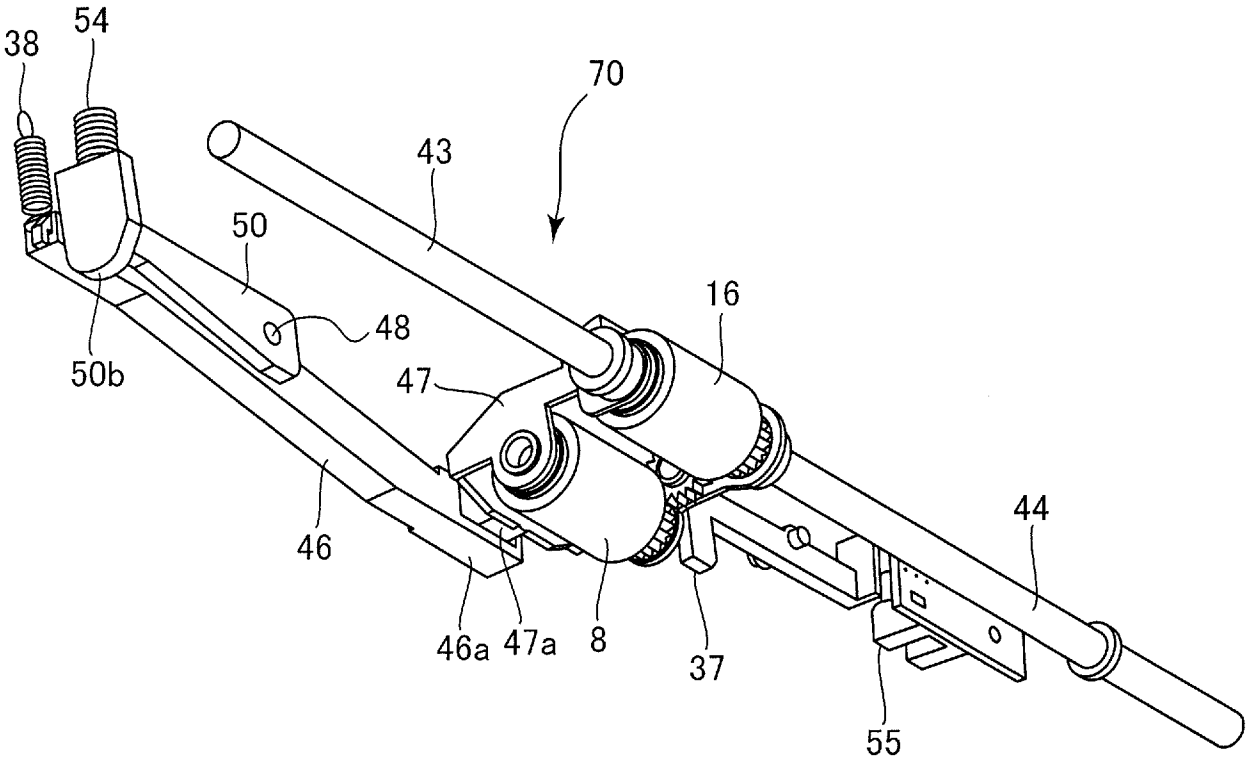
FIG. 2 is a perspective view of a movement unit viewed from below.

Next, the sheet conveying apparatus 106 will be described. As illustrated in FIGS. 1 and 2, the sheet conveying apparatus 106 includes a cassette 24, i.e., a stacking unit, the pickup roller 8, the feed roller 16, the separating roller 9, the conveyance guide 52, and a movement unit 70. The cassette 24 is provided drawably from the apparatus body 100A and includes the intermediate plate 21, i.e., stacking unit a stacking member, on which the sheets are stacked.

The intermediate plate 21 is provided pivotable about a supporting point 21*a* and a lift plate 22 is provided below the intermediate plate 21. A gear (not illustrated) is provided in one end of the lift plate 22 and power is transmitted to the gear (not illustrated) from a transmission gear provided in the cassette 24. The transmission gear is driven by a feeding motor M described below and the intermediate plate 21 pivots in response to the upward and downward movement of the lift plate 22 so as to move upward and downward.

The separating roller 9, which is in pressure contact with the feed roller 16, forms a separation nip between the separating roller 9 and the feed roller 16 where the sheets are separated one by one. A torque limiter (not illustrated) is provided in the separating roller 9. The torque of the torque limiter is set such that the separating roller 9 is rotated together with the feed roller 16 when a single sheet is fed by the pickup roller 8. The torque is also set such that the separating roller 9 does not rotate when multiple sheets are fed by the pickup roller 8, so that the sheets are separated one by one in the separation nip.

Figure 4:
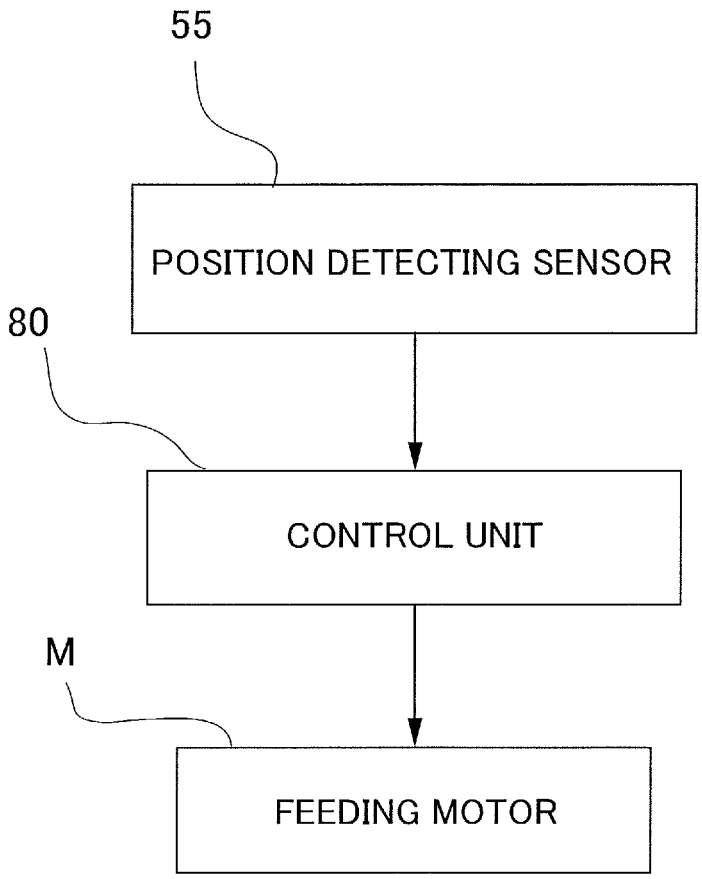
FIG. 4 is a block diagram illustrating a control unit.

Here, FIG. 4 illustrates a block diagram of the control unit 80 according to the present embodiment. A position detecting sensor 55 is connected to the control unit 80 on an input side and the feeding motor M is connected to the control unit 80 on an output side.

Figure 3A:
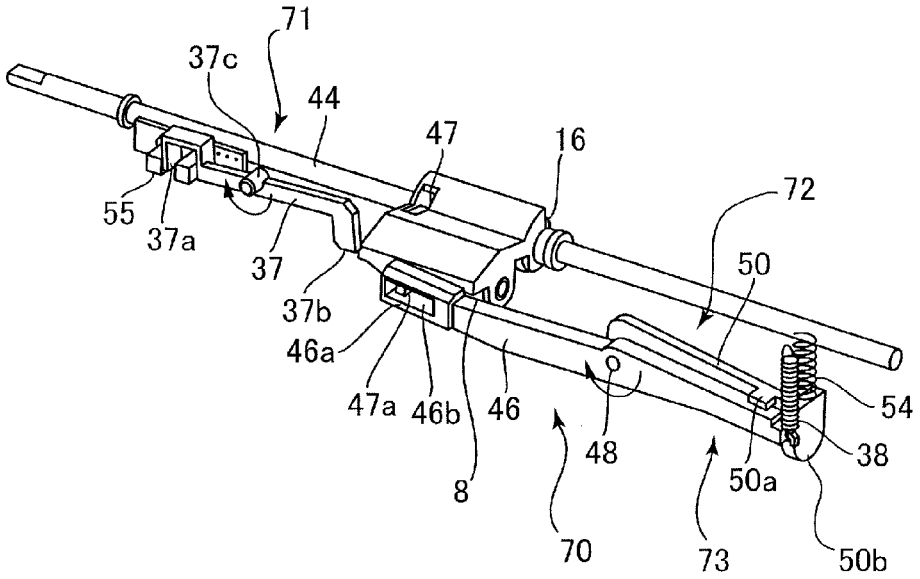
FIG. 3A is a perspective view illustrating the movement unit in a state where a pickup roller is positioned at the second position.
Figure 3B:
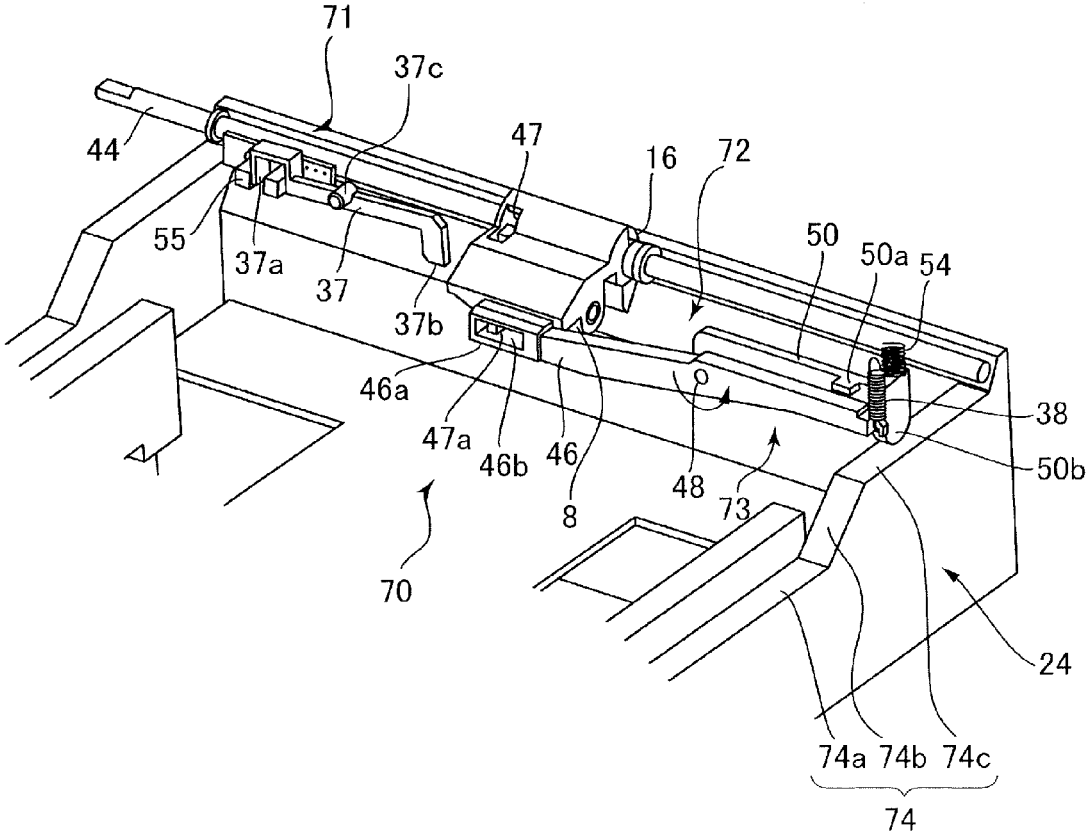
FIG. 3B is a perspective view illustrating the movement unit in a state where the pickup roller is positioned at the first position.

As illustrated in FIGS. 2, 3A, and 3B, the movement unit 70 includes a feed roller shaft 44 that rotatably supports the feed roller 16 and a roller holder 47, i.e., a support member. The roller holder 47 is pivotably supported on the feed roller shaft 44. The roller holder 47 supports the pickup roller 8 swingably between a first position (see FIG. 3B) and a second position (see FIG. 3A) above the first position.

In addition, the movement unit 70 includes a detecting mechanism 71 and a cam mechanism 72. The detecting mechanism 71 includes a sheet position detecting lever 37 pivotably supported on the apparatus body 100A and the position detecting sensor 55. In the present embodiment, a photo interrupter is used as the position detecting sensor 55. An abutting portion 37*b* and a flag portion 37*a* are respectively formed on one and the other end of the sheet position detecting lever 37 across a pivotal shaft 37*c*. The abutting portion 37*b* is formed to abut against the sheet S stacked on the intermediate plate 21. The flag portion 37*a* is formed to be able to cover the position detecting sensor 55.

The sheet position detecting lever 37 is urged by a spring (not illustrated) in such a direction that the abutting portion 37*b* approaches the sheet S. In a state where the cassette 24 has been just mounted on the apparatus body 100A, the abutting portion 37*b* has been moved downward since the sheet position detecting lever 37 is urged by the spring (not illustrated). Thus, the position detecting sensor 55 covered by the flag portion 37*a* is in a non-detection state.

Then, if the position detecting sensor 55 is in the non-detection state, the control unit 80 drives the feeding motor M and moves the intermediate plate 21 upward via the lift plate 22. The abutting portion 37*b* is pressed upward by the sheet S mounted on the intermediate plate 21 moving upward, and the flag portion 37*a* moves downward. If the position detecting sensor 55 is intercepted by the flag portion 37*a* moving downward to go into a detection state (see FIG. 3B), the control unit 80 stops driving of the feeding motor M and the upward movement of the intermediate plate 21 is stopped. In a position of the sheet position detecting lever 37 in which the position detecting sensor 55 is in the detection state, the sheet S abuts against the pickup roller 8 that is positioned at the first position by a predetermined pressure and feeding of the sheet S can be performed by the pickup roller 8.

If the sheets S mounted on the intermediate plate 21 are sequentially fed, a height of an upper surface of the sheet S is decreased. Thus, the pickup roller 8 moves downward by an urging force of a tension spring 38 described below, and continuously abuts against the sheet S. On the other hand, the sheet position detecting lever 37 is rotated along with the height of the upper surface of the sheet S being decreased and if the abutting portion 37*b* moves downward by a predetermined amount, the position detecting sensor 55 is in the non-detection state in which the light is not intercepted by the flag portion 37*a*.

When the position detecting sensor 55 comes into the non-detection state, the control unit 80 drives the feeding motor M to move the intermediate plate 21 upward using the lift plate 22. Thus, the abutting portion 37*b* moves upward and the flag portion 37*a* moves simultaneously downward, while the position detecting sensor 55 covered by the flag portion 37*a* comes into the detection state. When the position detecting sensor 55 comes into the detection state, the control unit 80 stops driving of the feeding motor M. Controlling the feeding motor M to move the intermediate plate 21 upward and downward as described above, the apparatus is able to maintain the upper surface level of the sheet as long as a sheet S to be fed remains so that the pickup roller 8 reliably feed the sheet S.

The cam mechanism 72 includes a pressing lever 46, i.e., a swing member, and a releasing lever 50, i.e., a release member. The pressing lever 46 and the releasing lever 50 are respectively supported on a pivotal shaft 48 provided in the apparatus body 100A and are respectively rotatable with respect to the pivotal shaft 48. In addition, the cam mechanism 72 includes the tension spring 38, i.e., a second urging member, a compression spring 54, i.e., a first urging member, and a cam surface 74 formed on the upper surface of the cassette 24. It is noted that the resilient members, the tension spring 38 and the compression spring 54, may be replaced by, for example, magnets.

On one end of the pressing lever 46 is formed an entry portion 46*a* with an opening 46*b*, i.e., a cavity portion. The opening 46*b* is engaged with a protrusion portion 47*a*, i.e., an engagement portion, provided at the end portion of the roller holder 47. Here, the roller holder 47 and the entry portion 46*a* are connected so that a backlash to absorb posture change of the pressing lever 46 in swinging is formed between the protrusion portion 47*a* and the opening 46*b*. The tension spring 38 is stretched between the apparatus body 100A and an end portion opposite to the entry portion 46*a* of the pressing lever 46. The tension spring 38 urges the pressing lever 46 counterclockwise in FIG. 3B. Since the pressing lever 46 is urged counterclockwise, the entry portion 46*a* comes to press downward the protrusion portion 47*a* of the roller holder 47. Thus, the pickup roller 8 is supported on the roller holder 47 is positioned at the first position on which the pickup roller 8 comes into contact with the sheet S. That is, the tension spring 38 defines an abutting pressure of the pickup roller 8 with respect to the sheet S by pressing the pickup roller 8 to the first position.

The releasing lever 50 includes a releasing portion 50*a* and a cam follower 50*b*, i.e., a movable portion, on the end portion opposite to the pivotal shaft 48. The compression spring 54 is stretched between the cam follower 50*b* and the apparatus body 100A. The compression spring 54 urges the releasing lever 50 clockwise in FIGS. 3A and 3B, while the releasing portion 50*a* is formed so as to abut against the upper surface of the pressing lever 46. The cam follower 50*b* is provided on a side portion in a width direction orthogonal to a feeding direction, i.e., a sheet conveyance direction, while the entry portion 46*a* is provided on a middle portion in the width direction. The pressing lever 46 and the releasing lever 50 configure a connection portion 73 that connects the entry portion 46*a* and the cam follower 50*b*.

The cam surface 74 formed on the upper surface of the cassette 24 includes a first horizontal surface 74*a*, a second horizontal surface 74*c*, and an inclined surface 74*b*. The second horizontal surface 74*c*, i.e., a contact portion, is formed above the first horizontal surface 74*a*. The inclined surface 74*b* connects the first horizontal surface 74*a* and the second horizontal surface 74*c*. The cam follower 50*b* of the releasing lever 50 moves upward and downward along the cam surface 74 under the urging force of the compression spring 54.

Next, the action of the pickup roller 8 in mounting operation and drawing operation of the cassette 24 will be described. When the cassette 24 is mounted on the apparatus body 100A, as illustrated in FIG. 3B, the cam follower 50*b* abuts against the second horizontal surface 74*c*. In this state, the releasing portion 50*a* of the releasing lever 50 is away from the pressing lever 46. Since the pressing lever 46 has been released from regulation, the pressing lever 46 is urged counterclockwise by the tension spring 38. Thus, the pickup roller 8 is positioned at the first position and comes into contact with the sheet S, as described above.

When the cassette 24 is drawn from the apparatus body 100A, the cam follower 50*b* moves downward, under the urging force of the compression spring 54, by sequentially sliding on the second horizontal surface 74*c*, the inclined surface 74*b*, and the first horizontal surface 74*a*. The cam follower 50*b* moving downward, the releasing portion 50*a* of the releasing lever 50 comes to press the pressing lever 46 to rotate the pressing lever 46 clockwise as illustrated in FIG. 3A. That is, the pressing lever 46 is restricted moving along the urging direction of the tension spring 38 by the releasing lever 50 and is moved along the urging direction of the compression spring 54. Thus, the entry portion 46*a* which moves upward makes the roller holder 47 pivot, and the pickup roller 8 is positioned at the second position on which the pickup roller 8 is away from the sheet S. It is noted that the urging force of the compression spring 54, in a state where the cassette 24 is removed from the apparatus body 100A as illustrated in FIG. 3A, is set to be greater than the urging force of the tension spring 38.

In other words, in drawing operation of the cassette 24 from the apparatus body 100A, the second horizontal surface 74*c* is separated from the cam follower 50*b* by the urging force of the compression spring 54 so that the pickup roller 8 moves from the first position to the second position.

Upon mounting the cassette 24 on the apparatus body 100A, the cam follower 50*b* moves upward sequentially sliding the first horizontal surface 74*a*, the inclined surface 74*b*, and the second horizontal surface 74*c* against the urging force of the compression spring 54. The cam follower 50*b* moving upward, the releasing portion 50*a* of the releasing lever 50 moves upward and the pressing lever 46 is rotated counterclockwise as illustrated in FIG. 3B under the urging force of the tension spring 38. Thus, the entry portion 46*a* which moves downward makes the roller holder 47 pivot, and the roller holder 47 stops at a position on which the pressing lever 46 abuts against a stopper (not illustrated). Now, the pickup roller 8 is positioned at the first position, on which the pickup roller 8 comes into contact with the sheet S, and a feeding operation of the sheet is performed with the pickup roller 8.

In other words, in mounting operation of the cassette 24 on the apparatus body 100A, the second horizontal surface 74*c* presses the cam follower 50*b* against the urging force of the compression spring 54 so that the pickup roller 8 is moved from the second position to the first position by the tension spring 38.

Meanwhile, the conveyance guide 51 is provided above the cassette 24 mounted on the apparatus body 100A. As illustrated in FIGS. 5 and 6, an opening 51*a* into which the entry portion 46*a* is moved is formed in a middle portion, in a direction orthogonal to the feeding direction, of the conveyance guide 51. As described above, drawing the cassette 24 from the apparatus body 100A, the pickup roller 8 moves upward from the first position to the second position. In this case, the entry portion 46*a* provided in the pressing lever 46 also moves upward. The opening 51*a* is provided such that the entry portion 46*a* moved upward does not interfere with the conveyance guide 51. In recent years, the demand for such a product has been met that has a low height, i.e., a printer downsized in the height direction. In such a printer, distances between the entry portion 46*a*, the roller holder 47, and the conveyance guide 51 become shorter.

Figure 5A:
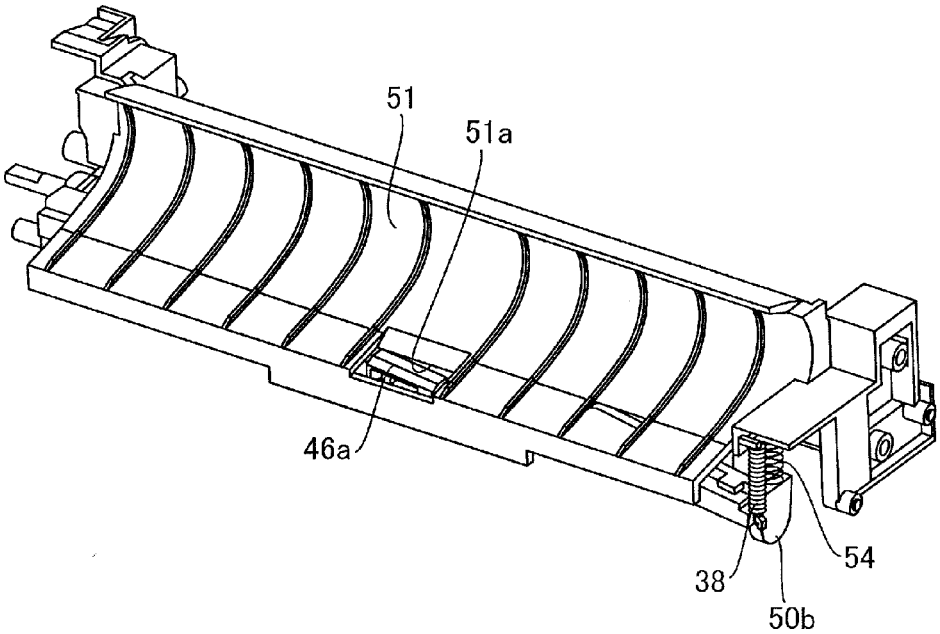
FIG. 5A is a perspective view illustrating a conveyance guide and an entry portion in a state where the pickup roller is positioned at the second position.
Figure 5B:
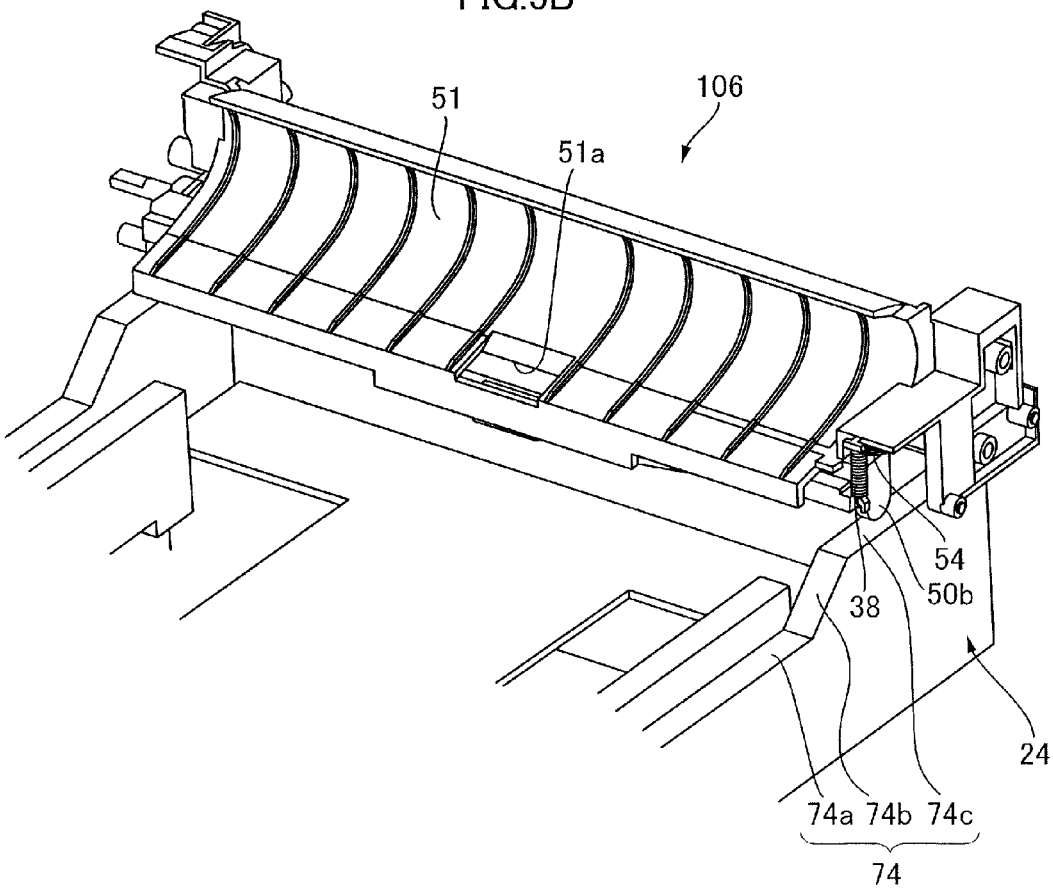
FIG. 5B is a perspective view illustrating the conveyance guide and the entry portion in a state where the pickup roller is positioned at the first position.
Figure 6A:
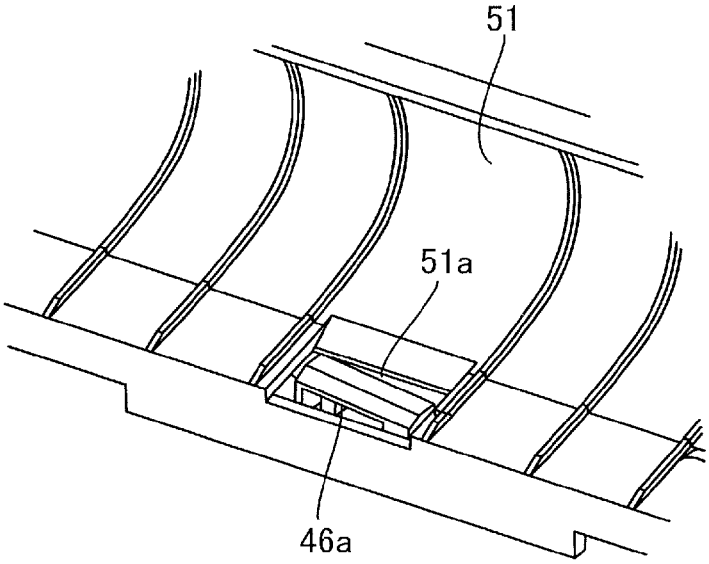
FIG. 6A is an enlarged perspective view illustrating the conveyance guide and the entry portion in a state where the pickup roller is positioned at the second position.
Figure 6B:
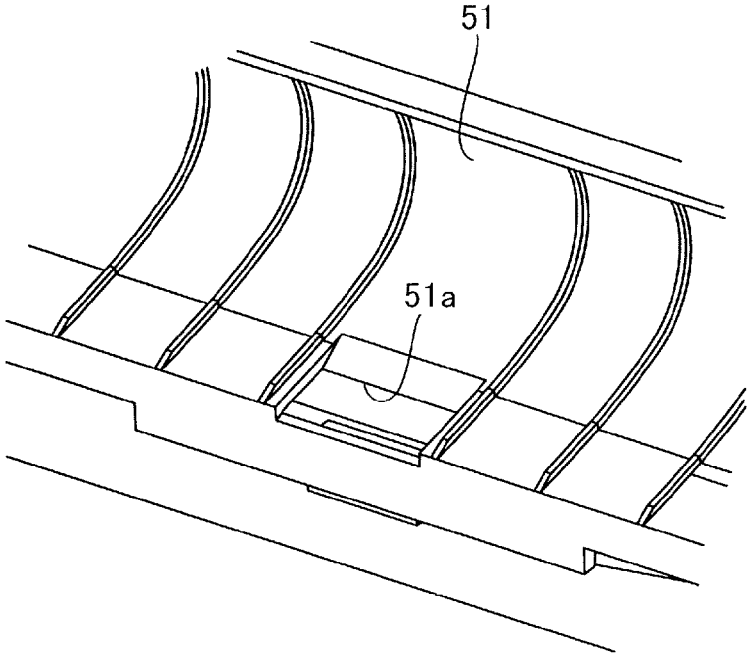
FIG. 6B is an enlarged perspective view illustrating the conveyance guide and the entry portion in a state where the pickup roller is positioned at the first position.
Figure 7A:
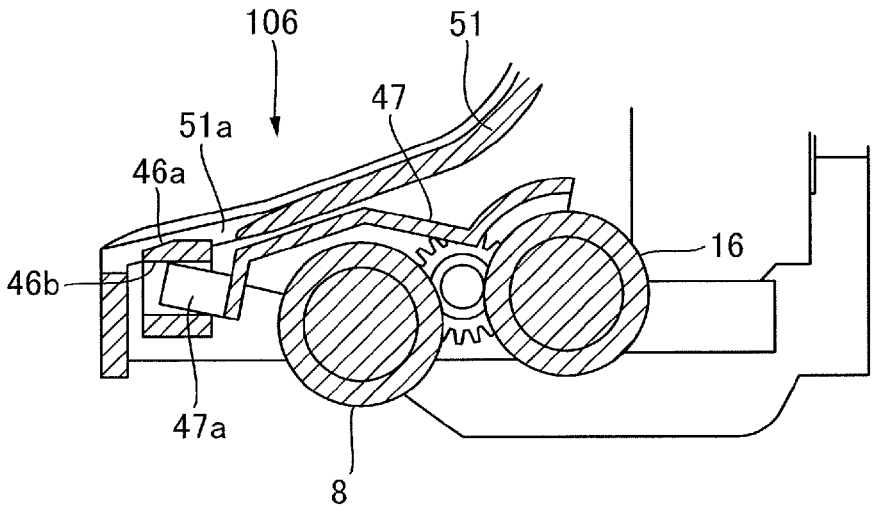
FIG. 7A is a side section view illustrating the conveyance guide and the entry portion in a state where the pickup roller is positioned at the second position.
Figure 7B:
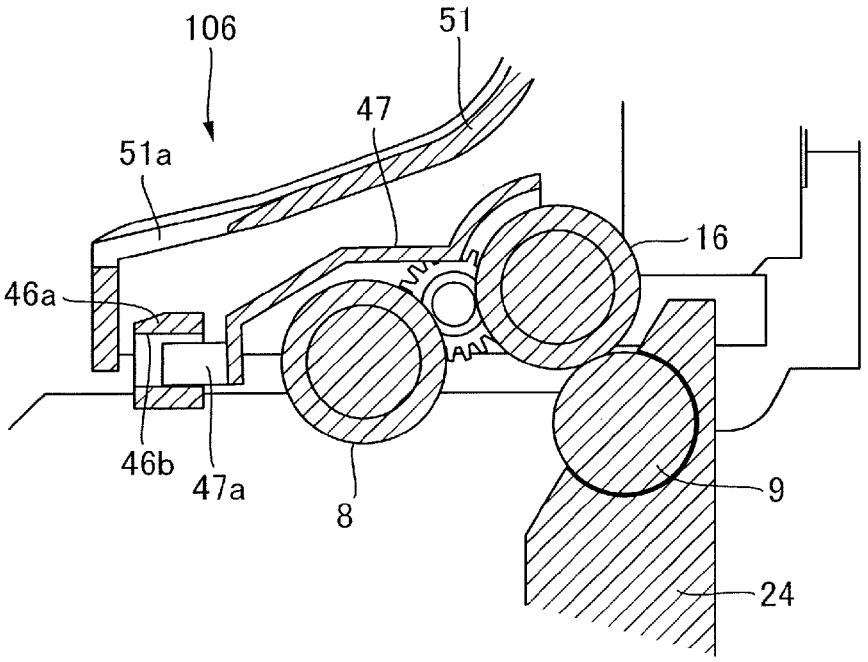
FIG. 7B is a side section view illustrating the conveyance guide and the entry portion in a state where the pickup roller is positioned at the first position.

As illustrated in FIGS. 5B, 6B, and 7B, in a state where the pickup roller 8 is positioned at the first position, the entry portion 46*a* is below the conveyance guide 51. Then, as illustrated in FIGS. 5A, 6A, and 7A, in a state where the pickup roller 8 is positioned at the second position above the first position, the entry portion 46*a* is located within the opening 51*a* of the conveyance guide 51.

It is noted that, when performing duplex printing in a state where the cassette 24 is mounted on the apparatus body 100A, the pickup roller 8 is positioned at the first position. In this case, as illustrated in FIG. 7A, the entry portion 46*a* does not protrude above the opening 51*a*. Thus, the sheet S can be smoothly conveyed through the duplex path 53 without interfering with the entry portion 46*a* that is positioned within the opening 51*a*.

As described above, according to the embodiment, since the opening 51*a* is formed in the conveyance guide 51, the entry portion 46*a* and the conveyance guide 51 do not interfere with each other in a case when the cassette 24 is drawn and the pickup roller 8 is positioned at the second position, The conveyance guide 51 and the entry portion 46*a* are thereby positioned close to each other in the height direction, enabling reduction (downsizing) of the height of the printer 1. In addition, while achieving downsizing of the printer 1, the pickup roller 8 is moved upward sufficiently away from the sheet S, preventing the sheet S from being damaged by the pickup roller 8 in a case when the cassette 24 is drawn.

It is noted that, in the present embodiment, the opening 51*a* is formed so that the entry portion 46*a* is positioned within. However, such an alternative configuration is considerable that an opening is formed larger than the opening 51*a* so as to be entered by the roller holder 47. With such a configuration, the degree of design flexibility of the conveyance guide 51 will be improved while achieving further downsizing of the apparatus.

It is noted that the present disclosure is not limited to the printer and can also be applied to another image forming apparatus such as a copier, a facsimile, and a multifunction printer.

Second Embodiment

Next, a second embodiment will be described. The second embodiment is provided by changing the configuration of the entry portion of the first embodiment. For the same configurations as those of the first embodiment, illustrations will be omitted and description will be provided by giving the same reference numerals.

Figure 8A:
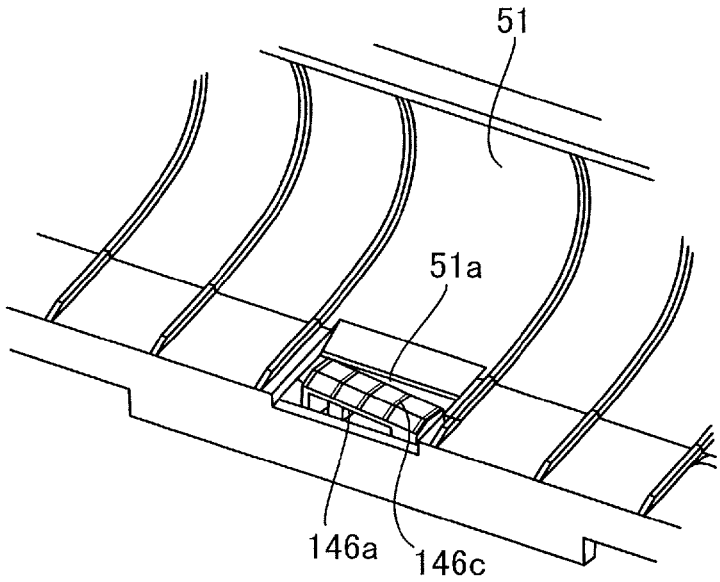
FIG. 8A is an enlarged perspective view illustrating a conveyance guide and an entry portion according to a second embodiment in a state where a pickup roller is positioned at a second position.

A sheet conveying apparatus 206 according to the second embodiment includes the pressing lever 46. As illustrated in FIGS. 8 and 9, an entry portion 146*a* with an opening 146*b* is formed in an end of the pressing lever 46. A plurality of ribs 146*c*, i.e., guide ribs, are formed upward on the upper surface of the entry portion 146*a* and extend along the sheet conveyance direction.

Figure 8B:
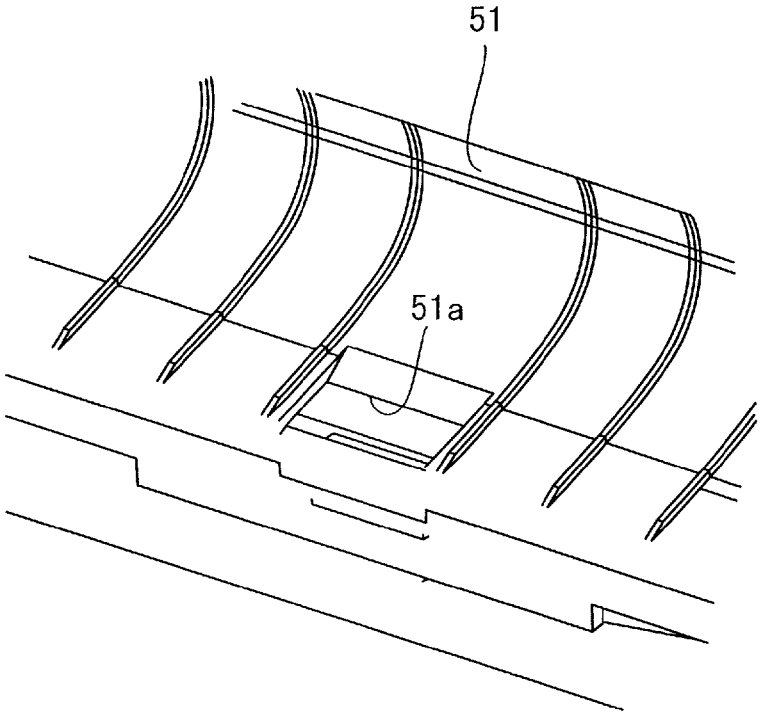
FIG. 8B is an enlarged perspective view illustrating the conveyance guide and the entry portion of the second embodiment in a state where the pickup roller is positioned at a first position.
Figure 9:
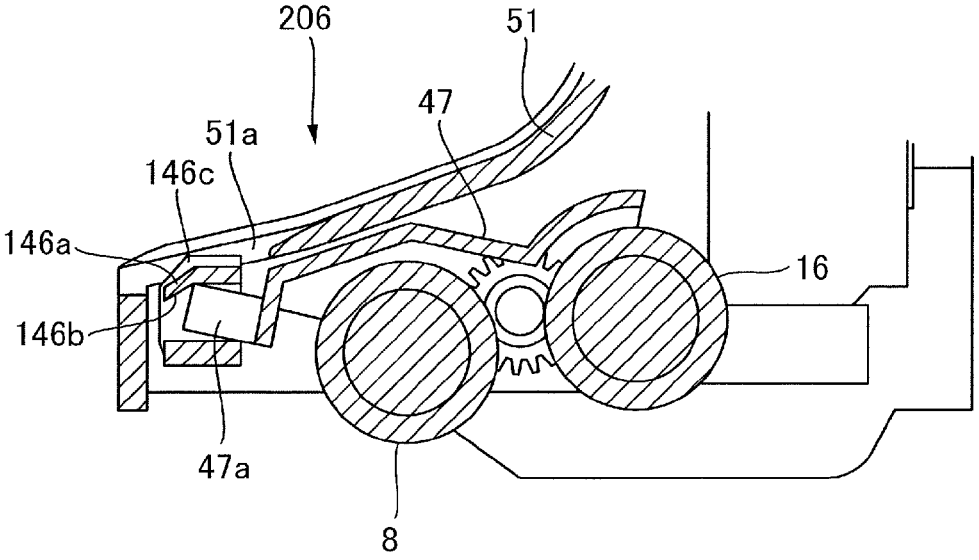
FIG. 9 is a side section view illustrating the conveyance guide and the entry portion in a state where the pickup roller according to the second embodiment is positioned at the second position.
Figure 10:
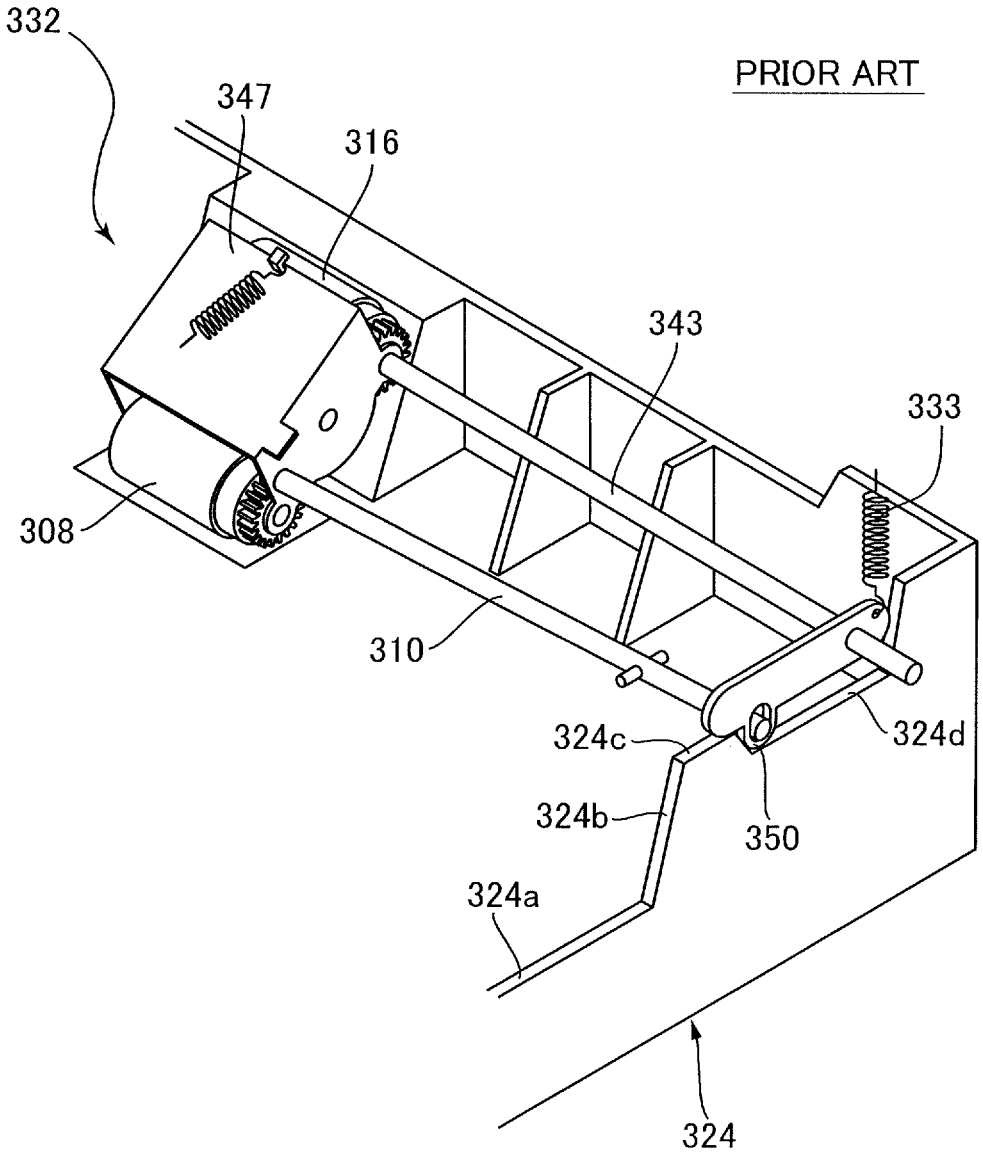
FIG. 10 is a perspective view illustrating a certain conventional sheet-feeding mechanism and a certain conventional sheet tray.

As illustrated in FIG. 8B, in a state where the pickup roller 8 is positioned at a first position, the entry portion 146*a* is positioned below the conveyance guide 51. On the other hand, as illustrated in FIGS. 8A and 9, in a state where the pickup roller 8 is positioned at a second position above the first position, the entry portion 146*a* is positioned within the opening 51*a* of the conveyance guide 51.

Here, in a state in which the cassette 24 is drawn from the apparatus body 100A and the pickup roller 8 is positioned at the second position, there is a case when the printer 1 performs duplex printing by feeding the sheet from the multi-feeding portion 107. In the first embodiment described above, however, there is a concern that the sheet S is caught by the entry portion 46*a* and a paper jam occurs, since the entry portion 46*a* protrudes within the opening 51*a*, as illustrated in FIG. 7A, Thus, in the embodiment, the ribs 146*c* are provided on the upper surface of the entry portion 146*a* so as to guide the sheet S passing through the duplex path 53 in a state where the pickup roller 8 is positioned at the second position.

Thus, it is prevented that jamming due to interference in the sheet S and the entry portion 146*a*. Thus, even in a state where the cassette 24 is drawn from the apparatus body 100A and the pickup roller 8 is positioned at the second position, the printer 1 is able to perform duplex printing by feeding the sheet from the multi-feeding portion 107.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No.2015-043473, filed on Mar. 5, 2015, which is hereby incorporated by reference herein in its entirety.

What is claimed is:

1. A sheet conveying apparatus comprising:

a stacking unit drawably mounted on an apparatus body, the stacking unit comprising a stacking member on which a sheet is stacked;

a feeding member configured to feed the sheet stacked on the stacking member;

a conveyance guide forming a conveyance path through which the sheet is conveyed, the conveyance guide being disposed above the stacking unit and having an opening; and a movement unit configured to move the feeding member between a first position on which the feeding member comes into contact with the sheet stacked on the stacking member and a second position disposed above the first position, the movement unit comprising an entry portion configured to be located within the opening upon the feeding member being positioned at the second position, wherein the stacking unit comprises a contact portion, wherein the movement unit comprises a movable portion configured to come into contact with the contact portion and a first urging member urging the feeding member toward the second position, wherein upon mounting the stacking unit on the apparatus body, the contact portion presses the movable portion against an urging force of the first urging member so as to move the feeding member from the second position to the first position, and wherein upon drawing the stacking unit from the apparatus body, the contact portion is separated from the movable portion so that the first urging member moves the feeding member from the first position to the second position.

2. The sheet conveying apparatus according to claim 1, wherein the entry portion comprises a guide rib formed on an upper surface of the entry portion so as to guide the sheet.

3. The sheet conveying apparatus according to claim 1, wherein the movement unit moves the feeding member, in response to a drawing operation of the stacking unit from the apparatus body, from the first position to the second position, and wherein the movement unit moves the feeding member, in response to a mounting operation of the stacking unit on the apparatus body, from the second position to the first position.

4. The sheet conveying apparatus according to claim 1, wherein the movement unit comprises a second urging member configured to urge the feeding member toward the first position, and wherein upon mounting the stacking unit on the apparatus body, the feeding member pressurized by the second urging member comes into pressure contact with the sheet stacked on the stacking member while the contact portion pressing the movable portion against the urging force of the first urging member.

5. The sheet conveying apparatus according to claim 4, wherein the urging force, in a state where the stacking unit is drawn from the apparatus body, of the first urging member is greater than an urging force of the second urging member.

6. The sheet conveying apparatus according to claim 4, wherein the movement unit comprises a connection portion connecting the entry portion and the movable portion.

7. The sheet conveying apparatus according to claim 6, wherein the connection portion comprises a swing member configured to swing in accordance with moving of the movable portion, and wherein the entry portion is supported on the swing member and integrally swings with the swing member so that the entry portion moves the feeding member between the first position and the second position.

8. The sheet conveying apparatus according to claim 7, wherein the movement unit comprises a support member supporting the feeding member and configured to pivot about a pivotal shaft extending in a direction orthogonal to a sheet conveyance direction so that the feeding member is moved between the first position and the second position, and wherein the support member comprises an engagement portion disposed on an end portion, on a side distant from the pivotal shaft, of the support member and configured to engage with the entry portion.

9. The sheet conveying apparatus according to claim 8, wherein the engagement portion comprises a protrusion portion, wherein the entry portion comprises a cavity portion formed to engage with the protrusion portion, and wherein the cavity portion and the protrusion portion are engaged to form a backlash to absorb posture change of the swing member in swinging.

10. The sheet conveying apparatus according to claim 7, wherein the connection portion comprises a release member configured to move integrally with the movable portion and to move independently from the swing member, wherein the swing member is coupled with the second urging member, and wherein the release member is coupled with the first urging member such that the release member restricts the swing member from moving under the urging force of the second urging member in a state where the movable portion is away from the contact portion, and that the release member releases the swing member in a state where the movable portion is pressed by the contact portion.

11. The sheet conveying apparatus according to claim 1, wherein the entry portion is provided on a middle portion in an orthogonal direction to the sheet conveyance direction while the movable portion is provided on a side portion in the orthogonal direction.

12. The sheet conveying apparatus according to claim 1, wherein the movement unit comprises a support member supporting the feeding member such that the support member swings between the first position and the second position, and wherein the entry portion is connected to the support member.

13. The sheet conveying apparatus according to claim 1, wherein the conveyance path formed by the conveyance guide configures a part of a duplex path through which the sheet that is formed an image on a first surface is conveyed to be formed another image on a second surface.

14. The sheet conveying apparatus according to claim 1, wherein the conveyance path is configured such that the sheet is conveyed while passing over the conveyance guide in a state where the stacking unit is drawn from the apparatus body.

15. The sheet conveying apparatus according to claim 1, further comprising a holder holding the feeding member and having an engage portion that engages with the entry portion.

16. An image forming apparatus comprising:

an image forming portion configured to form an image on a sheet; and a sheet conveying apparatus configured to convey the sheet, the sheet conveying apparatus comprising:

a stacking unit drawably mounted on an apparatus body, the stacking unit comprising a stacking member on which the sheet is stacked;

a feeding member configured to feed the sheet stacked on the stacking member;

a conveyance guide forming a conveyance path through which the sheet is conveyed, the conveyance guide being disposed above the stacking unit and having an opening; and a movement unit configured to move the feeding member between a first position on which the feeding member comes into contact with the sheet stacked on the stacking member and a second position disposed above the first position, the movement unit comprising an entry portion configured to be located within the opening upon the feeding member being positioned at the second position, wherein the stacking unit comprises a contact portion, wherein the movement unit comprises a movable portion configured to come into contact with the contact portion and a first urging member urging the feeding member toward the second position, wherein upon mounting the stacking unit on the apparatus body, the contact portion presses the movable portion against an urging force of the first urging member so as to move the feeding member from the second position to the first position, and wherein upon drawing the stacking unit from the apparatus body, the contact portion is separated from the movable portion so that the first urging member moves the feeding member from the first position to the second position.

17. A sheet conveying apparatus comprising:

a stacking unit drawably mounted on an apparatus body, the stacking unit comprising a stacking member on which a sheet is stacked;

a feeding member configured to feed the sheet stacked on the stacking member;

a conveyance guide forming a conveyance path through which the sheet is conveyed, the conveyance guide being disposed above the stacking unit and having an opening; and a movement unit configured to move the feeding member between a first position on which the feeding member comes into contact with the sheet stacked on the stacking member and a second position disposed above the first position, the movement unit comprising an entry portion configured to be located within the opening upon the feeding member being positioned at the second position, wherein the entry portion comprises a guide rib formed on an upper surface of the entry portion so as to guide the sheet.

* * * * *